US007824456B1

(12) United States Patent
Monson

(10) Patent No.: US 7,824,456 B1
(45) Date of Patent: Nov. 2, 2010

(54) EXTRACTOR

(76) Inventor: Clifford L. Monson, 6115 130th Ave. NE., Kirkland, WA (US) 98033

( * ) Notice: Subject to any disclaimer, the term of this patent is extended or adjusted under 35 U.S.C. 154(b) by 139 days.

(21) Appl. No.: 12/221,090

(22) Filed: Jul. 29, 2008

(51) Int. Cl.
*B01D 50/00* (2006.01)

(52) U.S. Cl. ..... 55/319; 55/467; 55/DIG. 3; 55/419; 96/329; 96/176; 96/333; 96/336; 96/337; 96/338; 96/339; 96/340; 15/347; 15/353

(58) Field of Classification Search ..... 55/319, 55/467, DIG. 3, 419; 96/337, 338, 339, 329, 96/176, 333, 335, 336, 340, DIG. 3; 15/353
See application file for complete search history.

(56) References Cited

U.S. PATENT DOCUMENTS

| | | | | | |
|---|---|---|---|---|---|
| RE33,074 | E * | 10/1989 | Levine | 15/344 |
| 4,874,404 | A * | 10/1989 | Boswell | 95/151 |
| 5,354,347 | A * | 10/1994 | McCoy et al. | 96/330 |
| 5,873,930 | A * | 2/1999 | Sanchez | 96/278 |
| 5,958,113 | A * | 9/1999 | Collins et al. | 96/329 |
| 6,033,462 | A * | 3/2000 | Dekker et al. | 95/248 |
| 6,616,733 | B1 * | 9/2003 | Pellegrin | 95/150 |
| 6,866,705 | B2 * | 3/2005 | Nielsen et al. | 96/276 |
| 7,297,188 | B2 * | 11/2007 | Nielsen et al. | 96/279 |
| 7,370,389 | B2 * | 5/2008 | Tsen | 15/353 |
| 2003/0010214 | A1 * | 1/2003 | Naruke | 96/337 |
| 2004/0006843 | A1 * | 1/2004 | Cankurtaran | 15/353 |
| 2005/0060836 | A1 * | 3/2005 | Nielsen et al. | 15/353 |
| 2005/0071947 | A1 * | 4/2005 | Yarbrough et al. | 15/353 |
| 2005/0108849 | A1 * | 5/2005 | Lam | 15/353 |
| 2006/0010639 | A1 * | 1/2006 | Yuen | 15/347 |
| 2008/0127449 | A1 * | 6/2008 | Hollis | 15/353 |

FOREIGN PATENT DOCUMENTS

DE 4024236 A1 * 2/1992

OTHER PUBLICATIONS

Century 400, Inc., Ninji Portable Extractor Operating Instructions, 31 pages, Chandler, Arizona, USA, Mar. 29, 2007.
Kleenrite Equipment, Kleenrite 36406E3 Carpet and Upholstery Cleaner Operator and Parts Manual, 20 pages, Madera, California, USA, Mar. 2002.
Mytee Products, Inc., Speedster 1000dx Portable Extractor Parts List and Drawings, Poway, California, USA, 3 pages, prior to Jul. 29, 2008.
Century 400, Inc. Stormchaser Portable Extractor Operating Instructions, 34 pages, Chandler, Arizona, USA, Oct. 10, 2005.
Mytee Products, Inc., M-12 Dual-Mode Extractor information, Poway, California, USA, 20 pages, prior to Jul. 29, 2008.

* cited by examiner

*Primary Examiner*—Jason M Greene
*Assistant Examiner*—Dung Bui
(74) *Attorney, Agent, or Firm*—Gregory W. Moravan

(57) ABSTRACT

An extractor that may have a diffuser located a vacuum chamber to which a vacuum is applied by a vacuum pump. The diffuser has cavity and at least one diffuser aperture, and receives a mixture of waste cleaning liquid and aspirated air. The diffuser and the vacuum chamber separate the waste cleaning liquid from the aspirated air. A suction hose and pump may remove the separated waste cleaning liquid from the vacuum chamber.

18 Claims, 14 Drawing Sheets

EXTRACTOR

STATEMENT REGARDING FEDERALLY SPONSORED RESEARCH OR DEVELOPMENT

The invention was not made by an agency of the United States Government or under a contract with an agency of the United States Government.

DETAILED DESCRIPTION OF THE INVENTION

A conventional wet vacuum floor-cleaning machine (hereinafter referred to as simply a "floor-cleaning machine") may comprise, for example: (a) any suitable dispensing apparatus for dispensing a cleaning liquid onto the floor being cleaned; (b) any suitable floor-cleaning apparatus, such as a motor driven brush or squeegee; and (c) any suitable vacuum apparatus for removing the waste cleaning liquid from the floor that is being cleaned, such as a vacuum hood or shroud. A conventional wet vacuum floor-cleaning machine may also be used to remove water, dirt and debris from a floor that has been flooded.

It is understood that as used herein, the term "waste cleaning liquid" may include not only the used or waste cleaning liquid itself, but may also include any flood water that is removed from the floor being cleaned, and may further include any dirt and debris that is carried by the waste cleaning liquid.

The floors that are cleaned may be soft surfaced, such as carpeted floors; or they may be hard surfaced, such as wood or tile floors. Any suitable cleaning liquid may be used with the floor-cleaning machine, such as water or any other suitable solvent; which may have added to it any suitable amount of any suitable cleaning agent, such as a detergent.

A conventional extractor may be used with the floor-cleaning machine to provide a vacuum for the floor-cleaning machine's vacuum apparatus, to enable the vacuum apparatus to suck up the waste cleaning liquid from the floor that is being cleaned. Along with the waste cleaning liquid, a large amount of air may be aspirated into the vacuum apparatus, and thus into the extractor, due to the imperfect seal that normally occurs between the vacuum apparatus and the floor that is being cleaned.

A conventional extractor may comprise: (a) a vacuum pump, (b) a holding tank for holding the waste cleaning liquid, (c) a pump or drain line for emptying the holding tank, and (d) an apparatus for permitting the aspirated air to be expelled from the extractor. Conventional extractors may have the problem of being prone to the negative effects of foam and waste cleaning liquid being sucked into its vacuum pump, which may harm the vacuum pump, and of being prone to the negative effects of foam and waste cleaning liquid being expelled into the room in which the extractor is being used.

Such foam may be generated, for example, by the floor cleaning-machine's floor-cleaning apparatus and by its vacuum apparatus, if the cleaning liquid includes an agent that may produce foam, such as a detergent. Such foam may also be generated within the vacuum hose that transports the waste cleaning liquid and aspirated air from the floor-cleaning machine to the conventional extractor, due to turbulence within the vacuum hose. Such foam may also be generated within the conventional extractor itself, due to turbulence within the conventional extractor.

Figure 1:
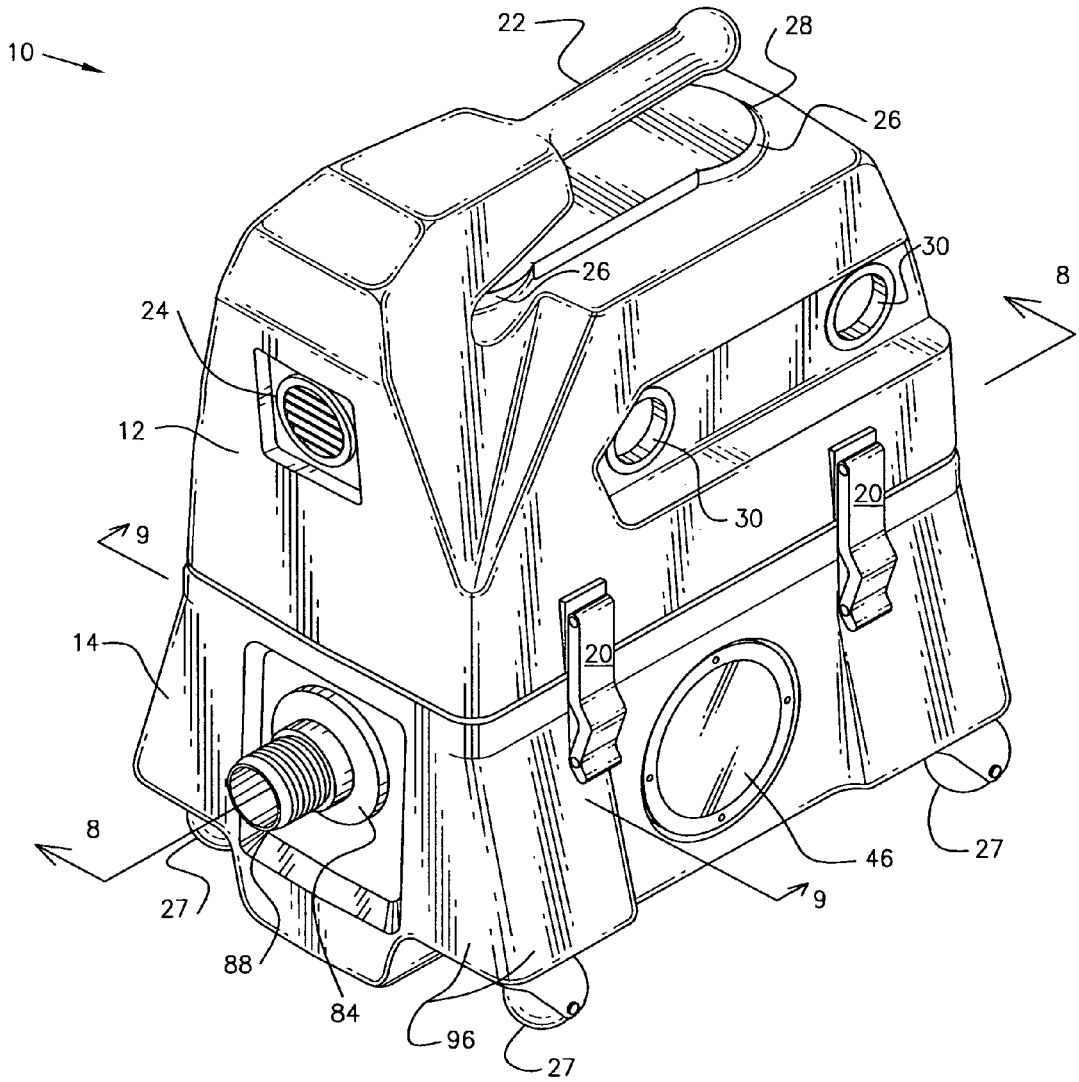
FIG. 1 is a perspective view of an extractor 10, taken from a front, upper right aspect.
Figure 2:
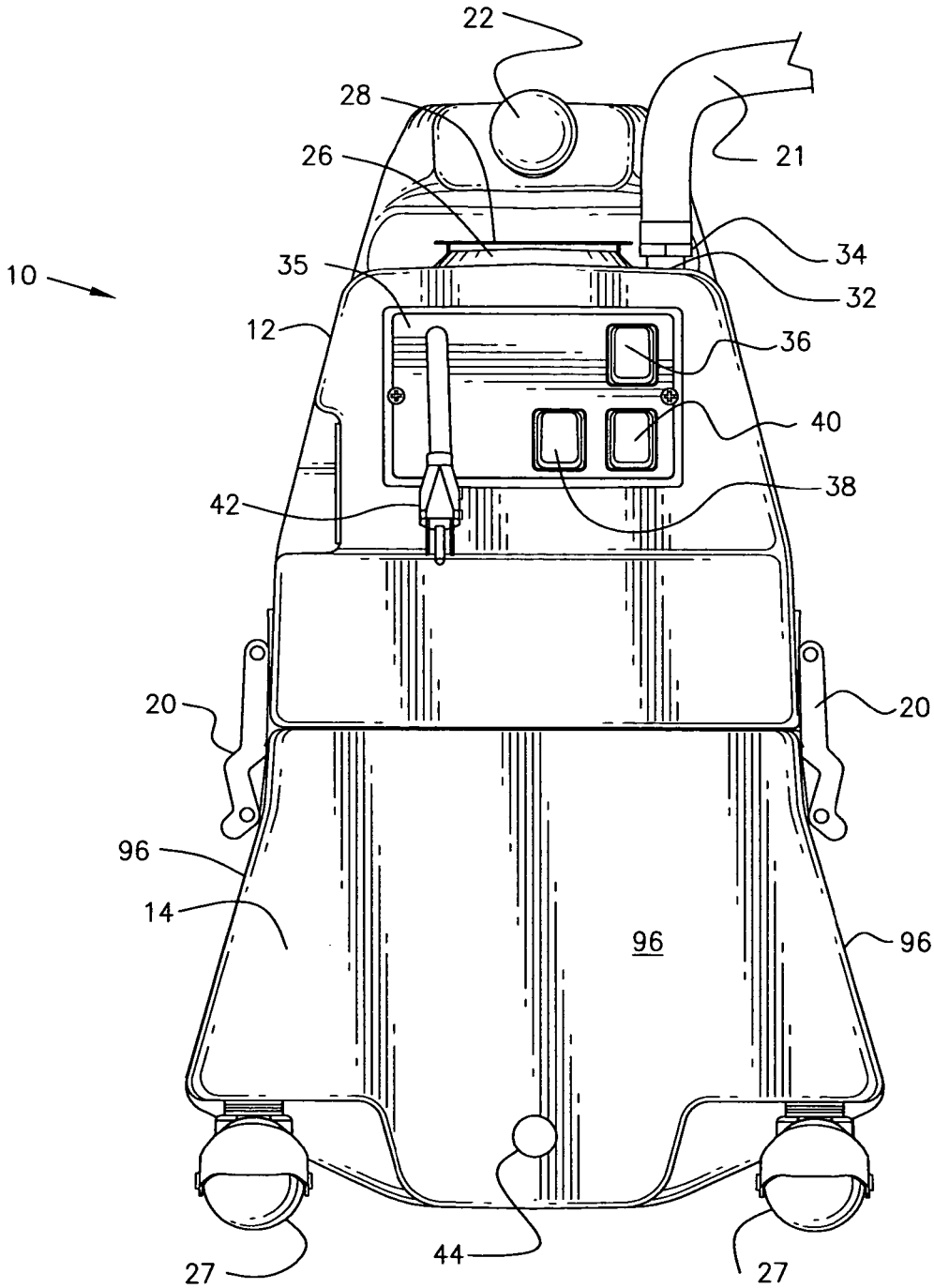
FIG. 2 is an end elevational view of the back of the extractor 10.
Figure 3:
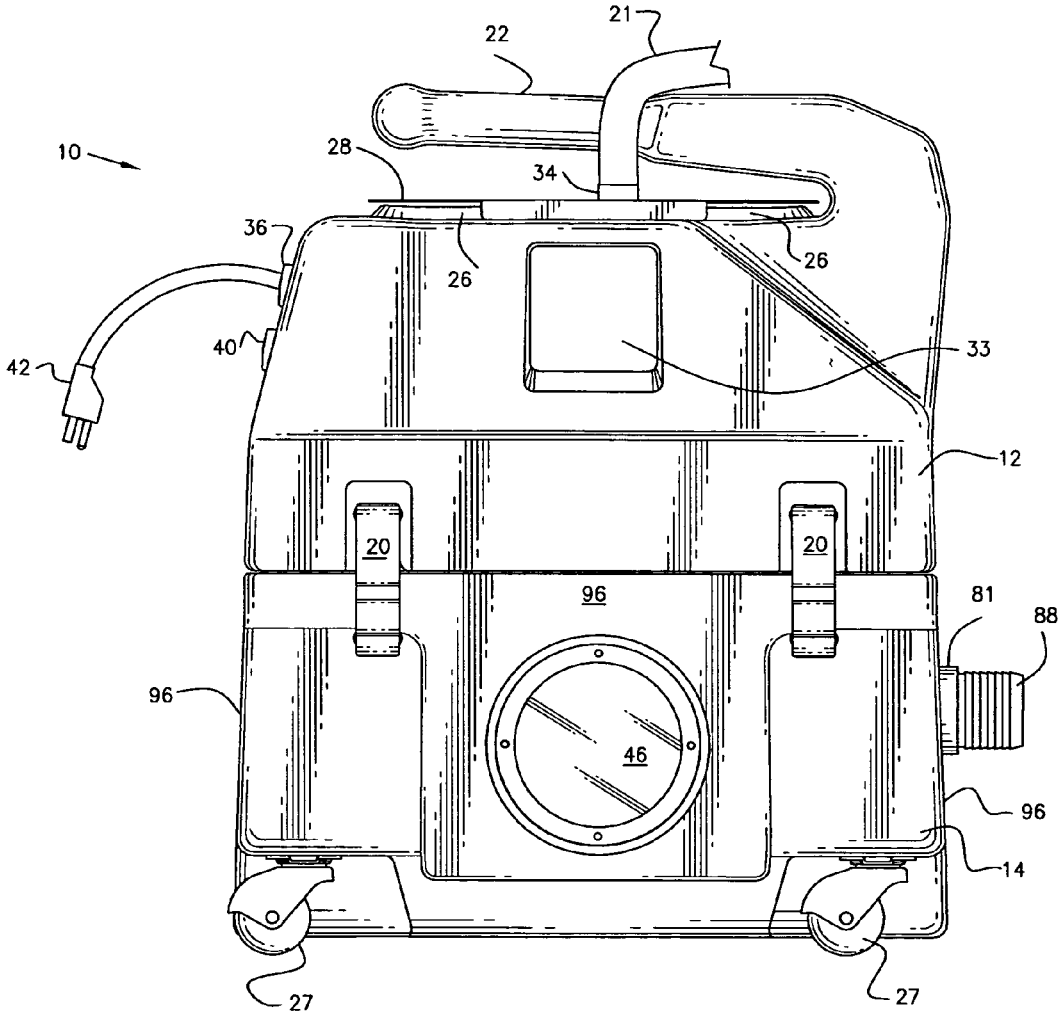
FIG. 3 is a side elevational view of the left side of the extractor 10.
Figure 4:
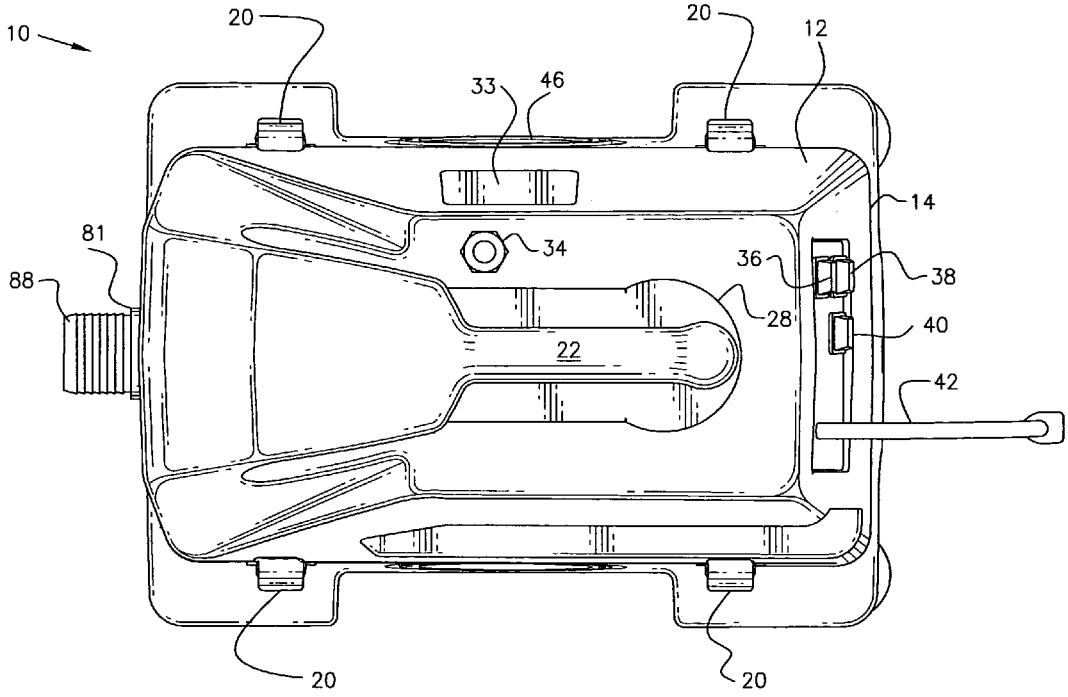
FIG. 4 is a top elevational view of the extractor 10.
Figure 5:
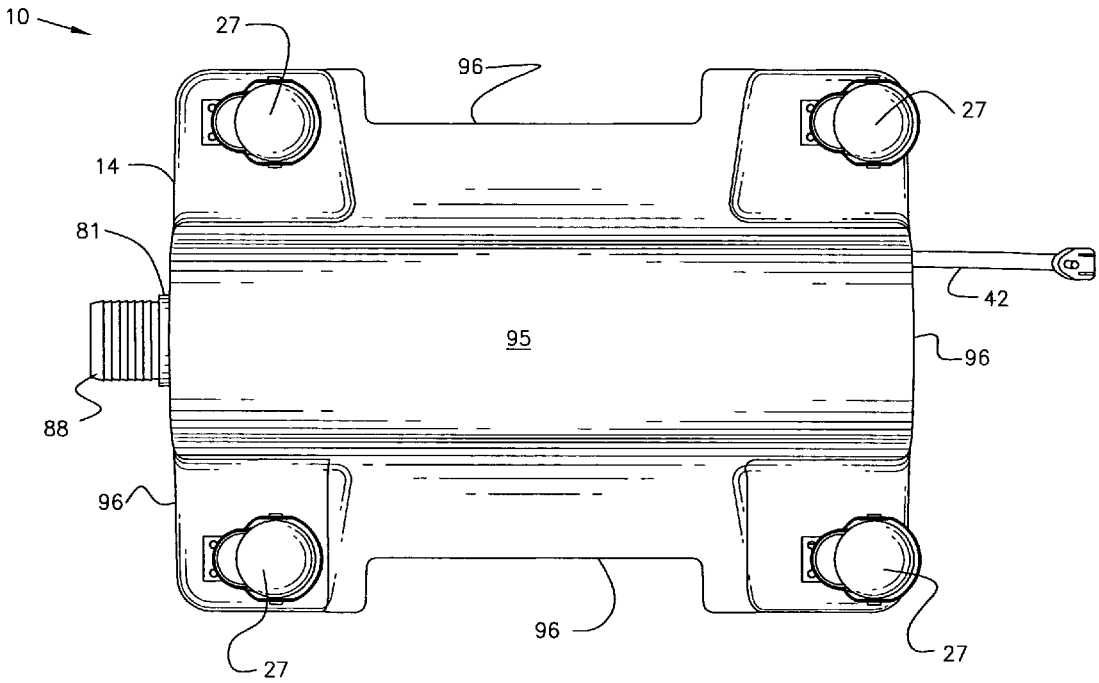
FIG. 5 is a bottom elevational view of the extractor 10.
Figure 6:
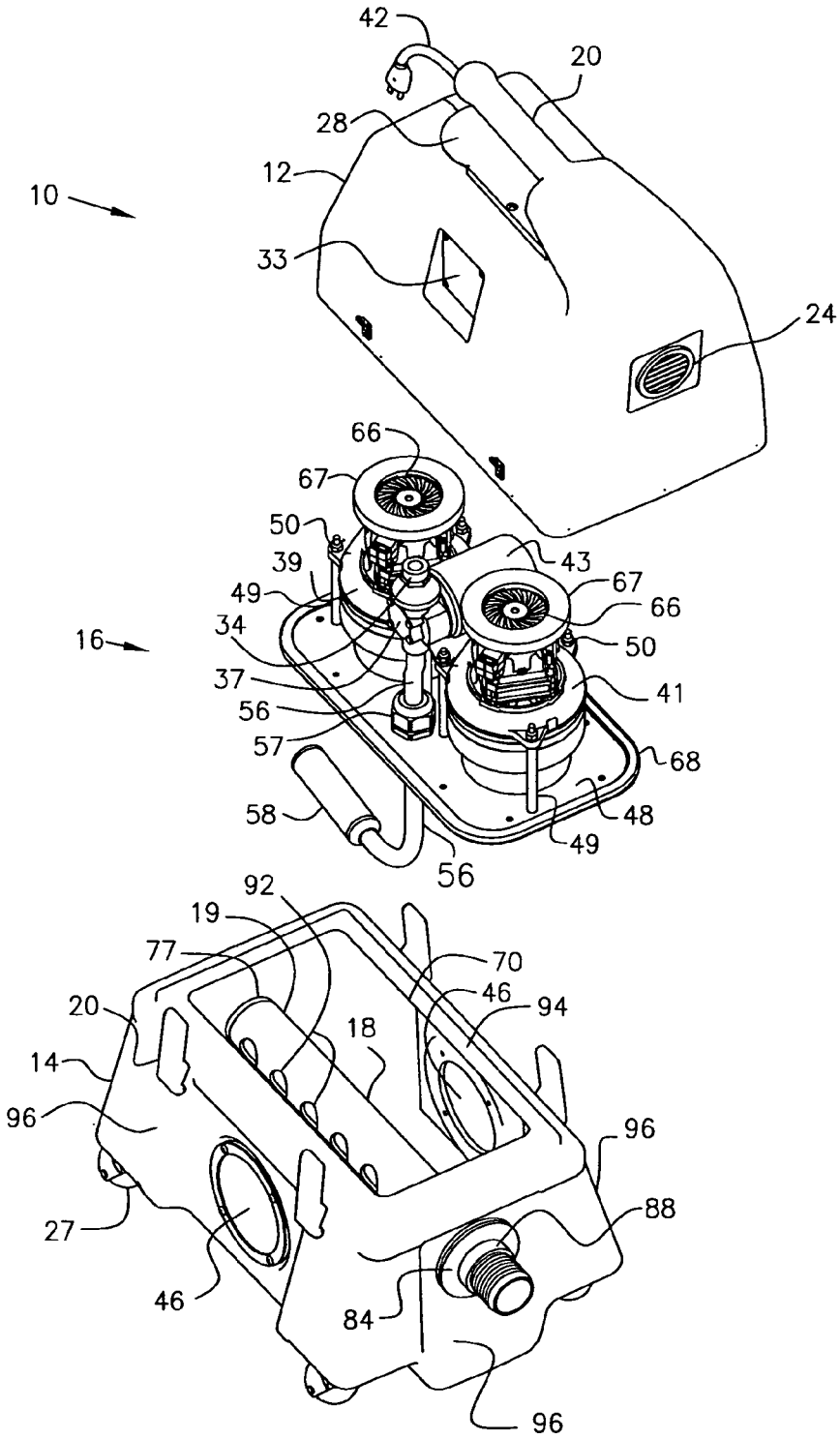
FIG. 6 is an exploded perspective view of the extractor 10, taken from a front, upper left aspect.
Figure 7:
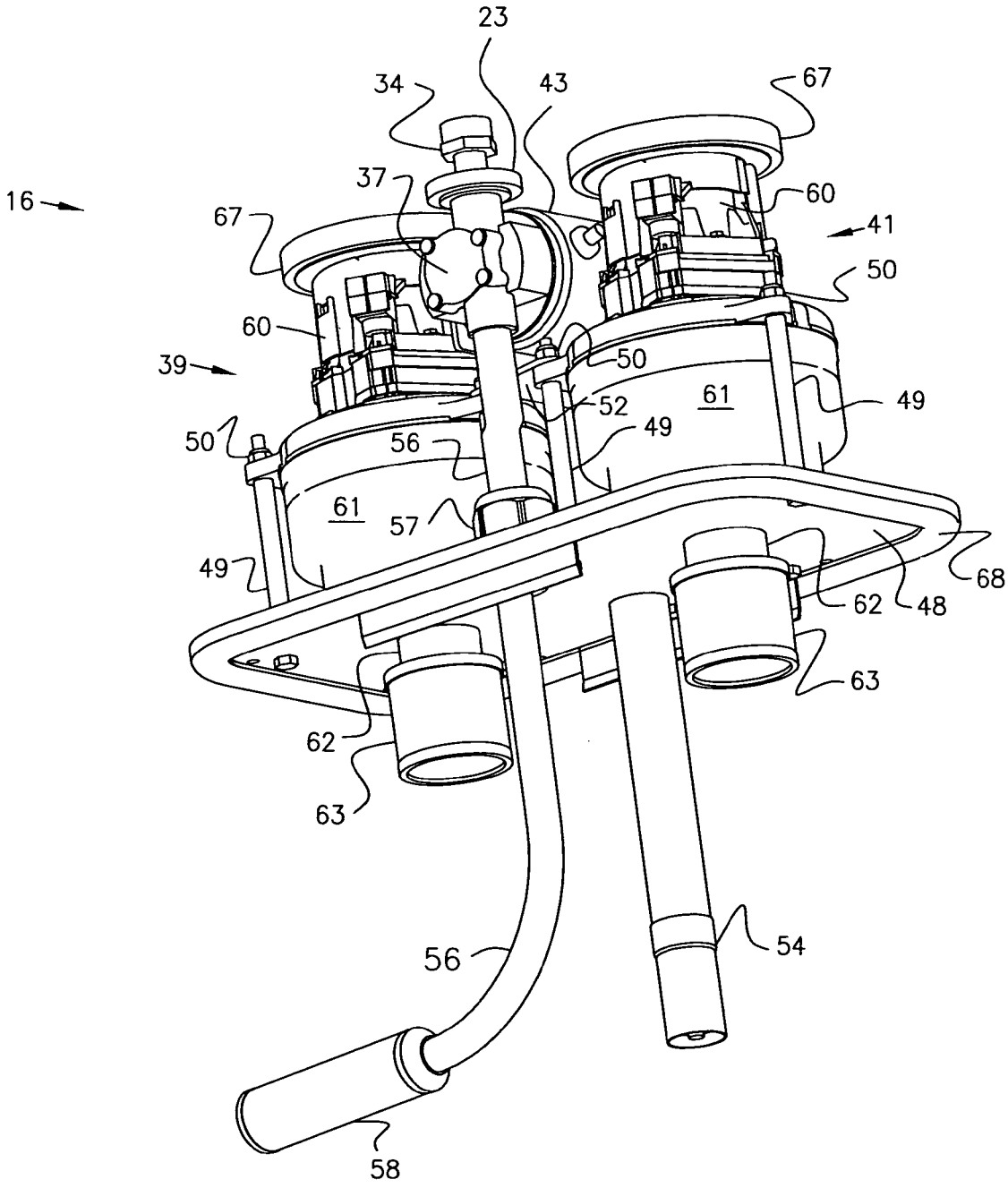
FIG. 7 is a perspective view of the extractor 10's vacuum deck assembly 16, taken from a front, lower left aspect.

Turning now to the Figures, as best seen in FIG. 6, the extractor 10 may comprise three main components, i.e., a top housing 12, a vacuum deck assembly 16, and a bottom housing 14 within which a diffuser 18 may be mounted. When the extractor 10 is assembled together, the vacuum deck assembly 16 may be sandwiched between the top and bottom housings 12, 14, which may be releasably held together in any suitable way, such as by the use of any suitable latches 20.

As best seen in FIGS. 6-9, the vacuum deck assembly 16 may comprise a pair of any suitable vacuum pumps 39, 41; and a deck plate 48 to which they may be mounted in any suitable way, such as by the use of mounting bolts 49 and nuts 50. The deck plate 48 may be provided with a gasket 68 having a U-shaped cross-sectional configuration. The gasket 68 may be mounted to the periphery of the deck plate 48, to provide an airtight seal between the deck plate 48, the top housing 12 and the bottom housing 14 when the top and bottom housings 12, 14 are assembled together with the latches 20.

As the latches 20 are secured, they may pull the top and bottom housings 12, 14 towards each other, to help effectuate a good seal: (a) between the deck plate 48's gasket 68, the bottom of the top housing 12, and the rim 94 of the top opening 70 in the bottom housing 14, (b) between the gaskets 67 of the cooling air outlets 66 of the electric motors 60 and their respective cooling air outlet ports 26 in the top housing 12, and (c) between the outlet coupling 34's gasket 23 and the inside of the top housing 12.

The purpose of the vacuum pumps 39, 41 is to provide a source of vacuum for the vacuum chamber 72 which may be defined between the deck plate 48 and the bottom housing 14.

Although two vacuum pumps 39, 41 are illustrated, there may be only one vacuum pump 39, 41. The size, power and number of the vacuum pumps 39, 41 will depend on such variables as the amount of room available for them within an extractor 10 having any given size and shape, and on the desired maximum flow rate of the aspirated air through the extractor 10.

Each vacuum pump 39, 41 may have any suitable construction, such as an electric motor 60 that drives a vacuum impeller within a vacuum pump housing 61. Each vacuum pump housing 61 may comprise a vacuum air inlet 62, a vacuum air outlet 64, and any suitable filter 63 for its vacuum air inlet 62. The filter 63 may be selected to help prevent any waste cleaning liquid, dirt, fibers and debris from entering the vacuum pump housing 61 where it might cause damage, and from entering the room within which the extractor 10 is being used, where it might harm or soil the user or the room and its furnishings.

A gasket may be provided for the vacuum air outlet 64 to provide an airtight seal between the vacuum air outlet 64 and the inside of the top housing 12. Each electric motor 60 may have a cooling air outlet 66, and a gasket 67 for providing an airtight seal between its cooling air outlet 66 and its respective cooling air exhaust port 26 in the top housing 12.

The vacuum deck assembly 16 may further comprise a suction tube 56 for removing waste cleaning liquid from the pool 25 of waste cleaning liquid in the bottom 95 of the vacuum chamber 72.

Figure 8:
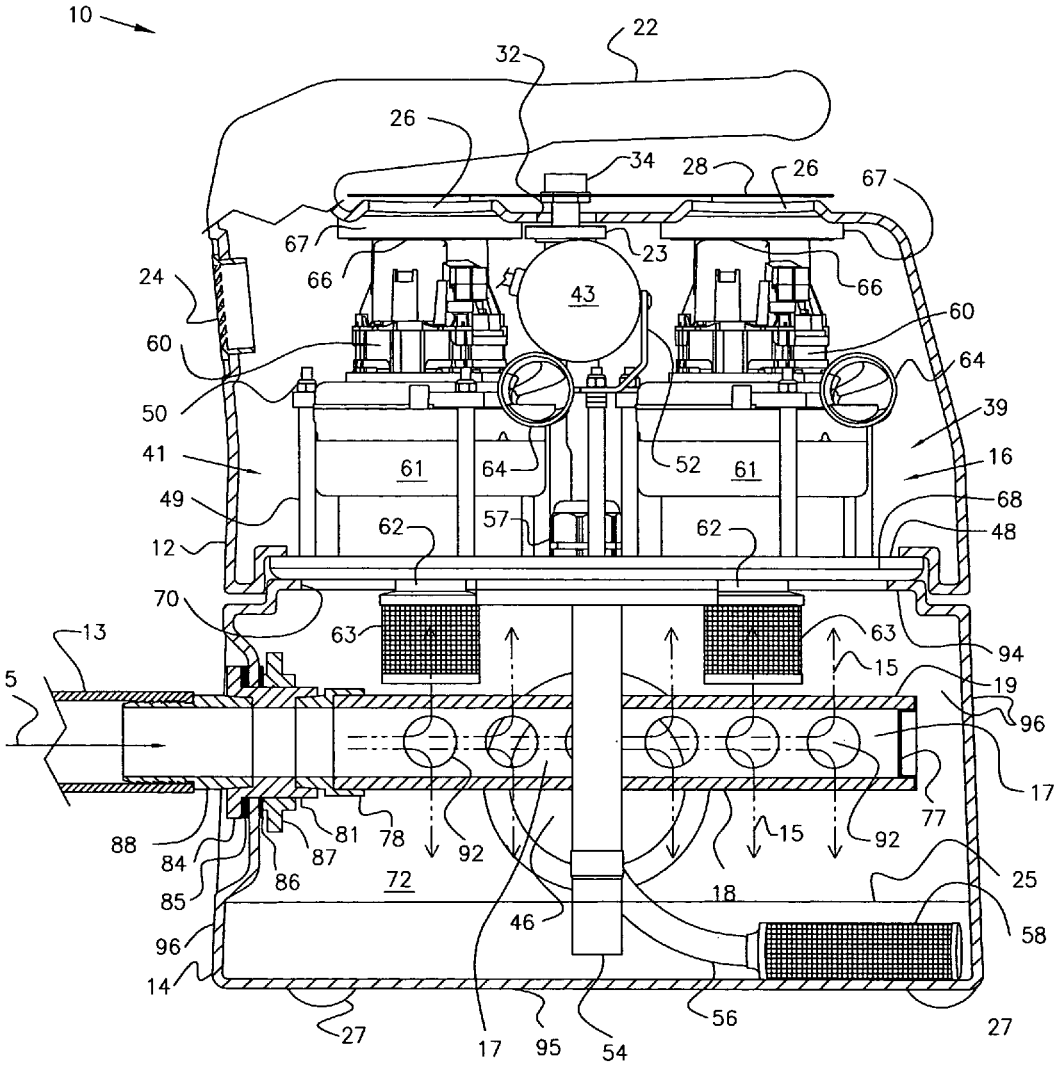
FIG. 8 is a side view of the extractor 10, with its diffuser 18 and its bottom housing 14 shown in a cross-section taken along line 8-8 of FIG. 1, with its vacuum deck assembly 16 shown in elevation, and with part of its top housing 12 shown broken away.
Figure 9:
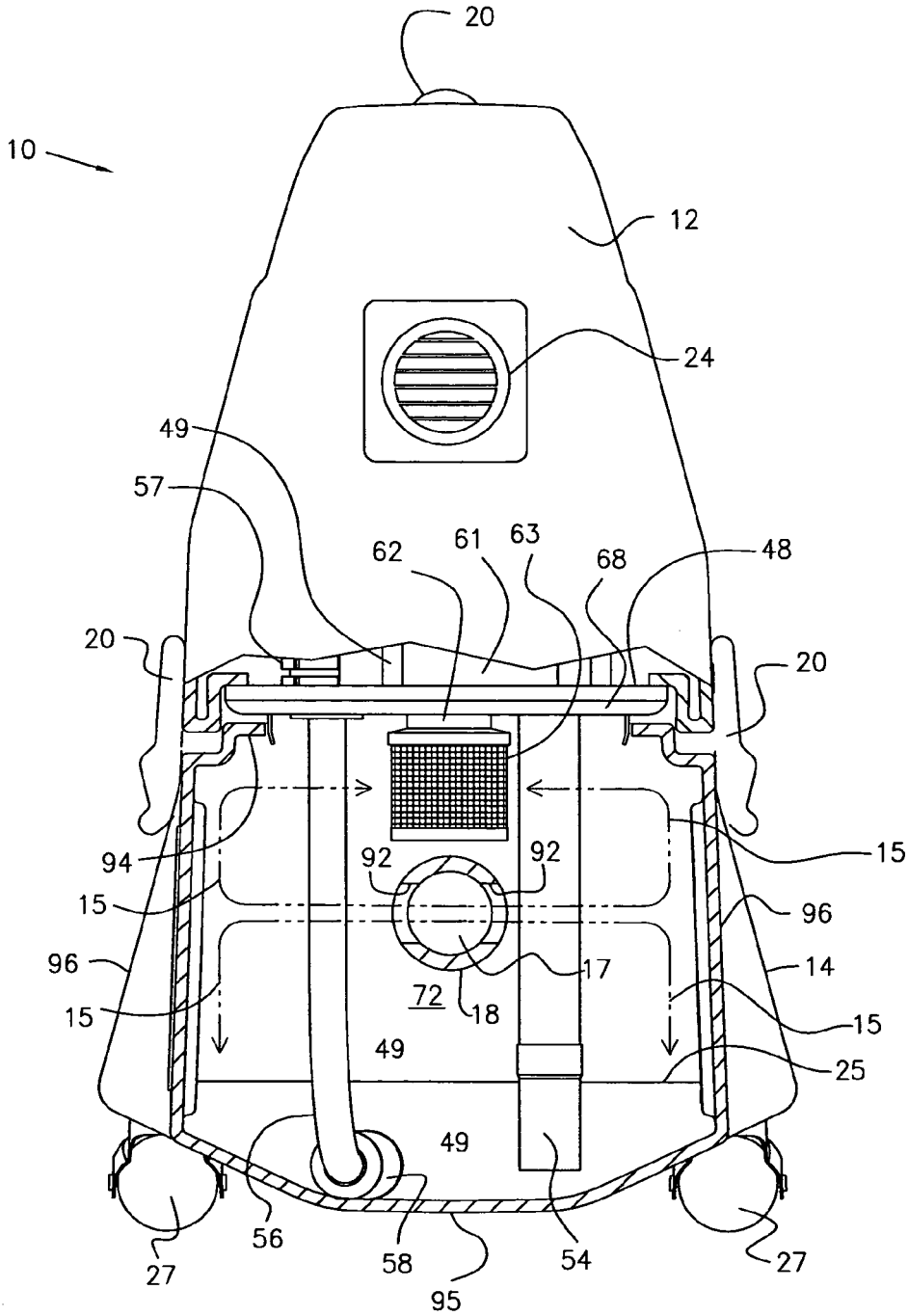
FIG. 9 is an end view of the front of the extractor 10, with its bottom housing 14 and diffuser 18 shown in a cross-section taken along 9-9 of FIG. 1, with some of its vacuum deck assembly 16's components shown in elevation, and with part of its top housing 12 shown broken away.

In this context the term "pool" is used very broadly, so it may encompass a large pool as seen in FIGS. 8-9, a small pool that may cover only a portion of the bottom 95 of the vacuum chamber 72, or a pool that is so small that it may intermittently or continuously cover only part of the inlet of the suction tube 56.

The vacuum deck assembly 16 may further comprise any suitable filter 58 on the inlet end of the suction tube 56, a vacuum-tight coupling 57 in the deck plate 48 for the suction tube 56, and a waste pump 37 that is connected to the outlet end of the suction tube 56. The filter 58 may be selected to prevent any harmful dirt, fibers and debris in the pool 25 of waste cleaning liquid from entering the suction tube 56 and being carried to, and possibly damaging, the waste pump 37.

The waste pump 37 may comprise any suitable outlet fitting 34 to which any suitable waste line 21 may be connected in any suitable way. The purpose of the waste line 21 is to convey the waste cleaning liquid from the waste pump 37 to any suitable place for disposing of it, such as a floor drain, sink or toilet. The outlet fitting 34 may be provided with a gasket 23 to provide an airtight seal between it and its hole 32 in the top housing 12.

The waste pump 37 and its electric motor 43 may be mounted to the deck plate 48 in any suitable way, such as by being secured to a mounting plate 52 which is, in turn, secured to the deck plate 48 with mounting bolts 49 and nuts 50.

As best seen in FIGS. 7-10, the vacuum deck assembly 16 may further comprise a waste cleaning liquid level sensor 54. The liquid level sensor 54 may be mounted to the deck plate 48 in any suitable way. The purpose of the liquid level sensor 54 is to turn on the electric motor 43 for the waste pump 37 when the level of the waste cleaning liquid in the pool 25 in the bottom of the vacuum chamber 72 rises to a predetermined upper limit, and to turn off the electric motor 43 when that level drops to a predetermined lower limit. When the sensor 54 activates the waste pump 37, the waste pump 37 pumps the waste cleaning liquid out of the pool 25 through the filter 58 and the suction tube 56, and then pumps the waste cleaning liquid out of the extractor 10 through the waste hose 21 that is attached to the outlet coupling 34 of the waste pump 37.

Figure 10:
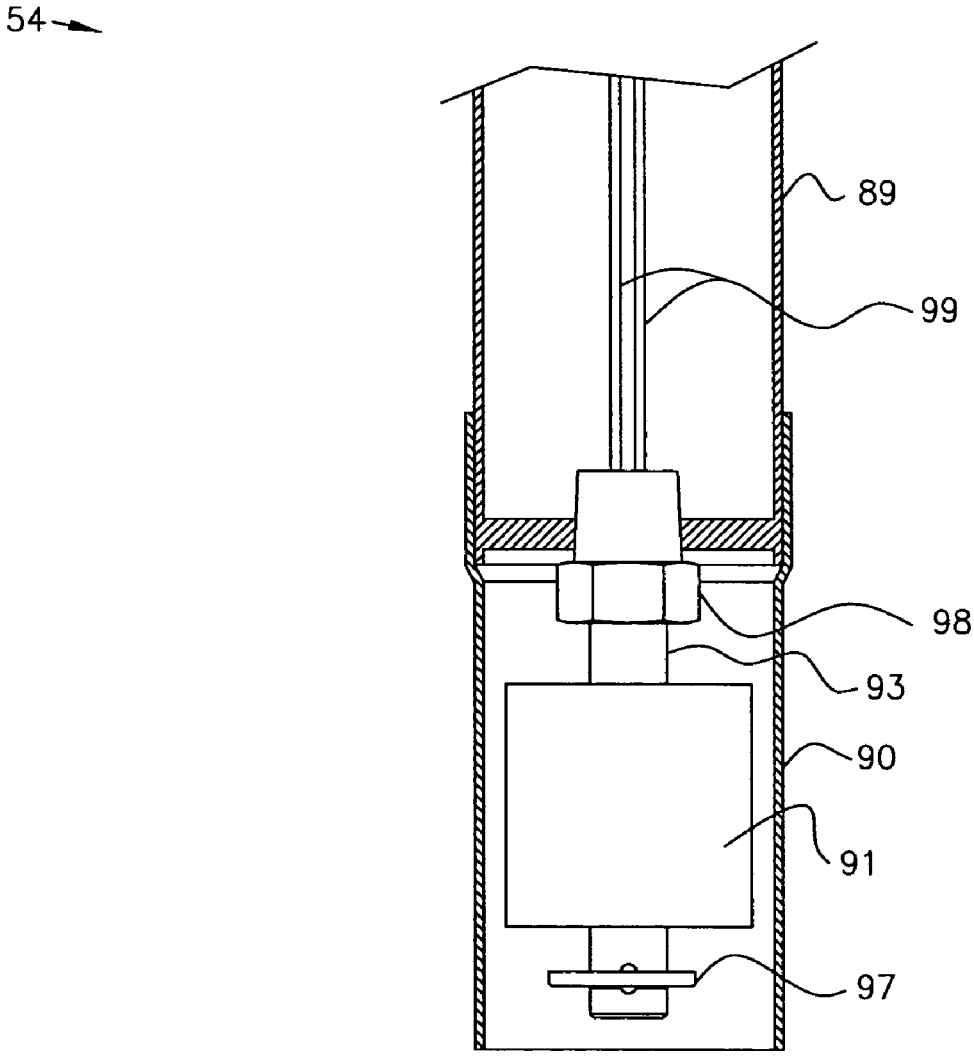
FIG. 10 is a cross sectional view of the extractor 10's liquid level control assembly 54.

Any suitable level sensor 54 may be used, such as the magnetic reed switch level sensor 54, which is best seen in FIG. 10. The level sensor 54 may comprise a mounting tube 89, a sensor protecting tube 90, a float 91 containing an internal magnet, a float shaft 93 containing an internal magnetic reed switch 104 (see FIG. 12), a float stop 97 on the bottom of the float shaft 93, a mount 98 for mounting the float shaft 93 to the bottom of the mounting tube 89, and electrical wires 99 connected to the reed switch 104 within the float shaft 93.

During operation of the liquid level sensor 54, the waste cleaning liquid that enters the open bottom of the sensor protecting tube 90 carries the float 91. When the depth, or level, of the waste cleaning liquid in the pool 25 in the bottom of the vacuum chamber 72 reaches a predetermined upper limit, the magnet in the float 91 closes the reed switch 104 that is located within the float shaft 93. When the reed switch 104 is closed, electrical power is supplied via the wires 99 to actuate a relay 100 that closes a switch 102 to provide power to the electric motor 43 for the waste pump 37. See the electrical schematic of FIG. 12.

Then, when the level of the pool 25 of waste cleaning liquid drops to a predetermined lower limit, the reed switch 104 opens, because the magnet in the float 91 is no longer close enough to it to keep it closed. As a result, power to the relay 100 is cut off, which then opens the switch 102 to turn off the waste pump 37's electric motor 43.

Referring now to FIGS. 1-6, 8-9, and 11, the top housing 12 may comprise an optional handle 22 for carrying the extractor 10; a cooling air inlet port 24 for the electric motors 66 of the vacuum pumps 39, 41; a respective cooling air exhaust port 26 for the cooling air outlet 66 of each of the electric motors 66; and an optional protective cover 28 for the cooling air exhaust ports 26.

Figure 11:
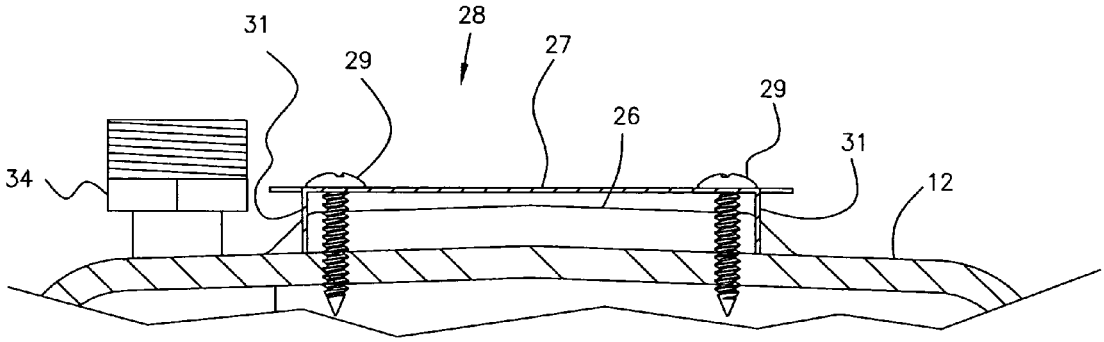
FIG. 11 is an enlarged front view of a top portion of the extractor 10, partly in cross-section and partly in elevation, showing the mounting of the cover 28 for the cooling air outlet ports 26.

As best seen in FIG. 11, the cover 28 may comprise a top plate 27 and a pair of spacing legs 31. The cover 28 may be secured to the top housing 12 by mounting screws 29. The spacing legs 31 have a height selected to space the top plate 27 away from the ports 26 a distance sufficient so that the top plate 27 does not unduly impede the flow of cooling air from the ports 26.

Turning again to FIGS. 1-6, 8-9, and 11, the top housing 12 may further comprise a respective vacuum exhaust port 30 for each of the vacuum air outlets 64 of the vacuum pumps 39, 41; a hole 32 for a waste cleaning liquid outlet coupling 34; and a removable access cover 33 for providing access to the waste cleaning liquid pump 37.

Figure 12:
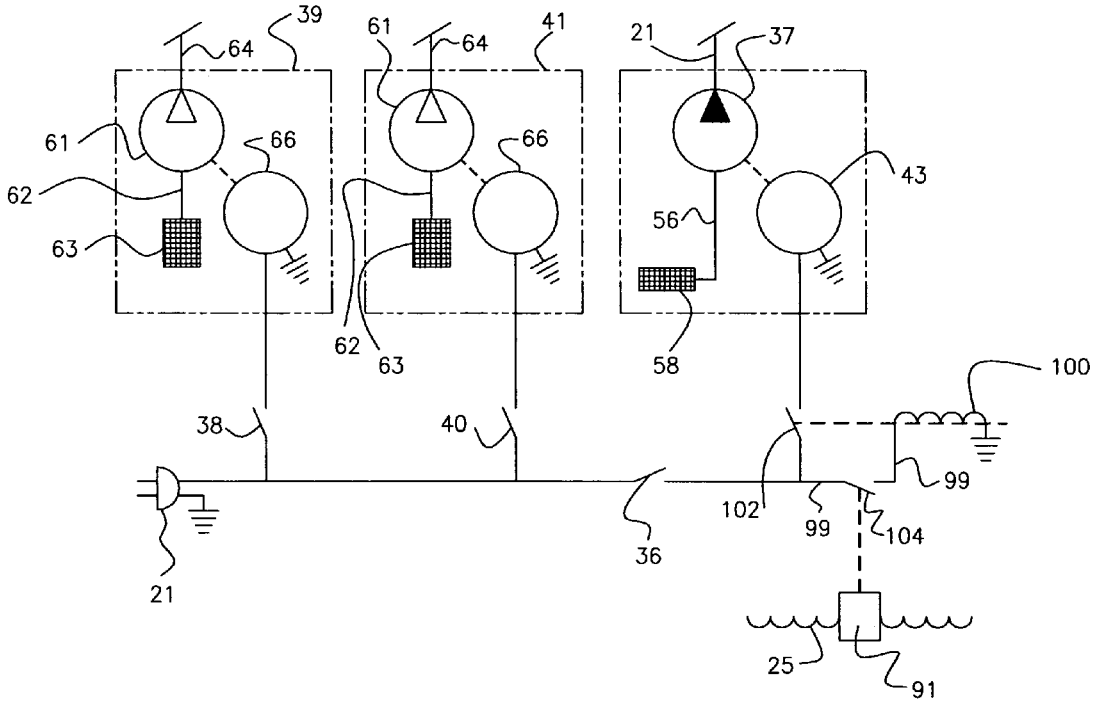
FIG. 12 is an electrical schematic for the extractor 10.

The top housing 12 may further comprise an electrical panel 35 carrying an on/off switch 36 for the waste pump 37's electric motor 43, a respective on/off switch 38, 40 for each of the electric motors 60 of the vacuum pumps 39, 41, and an electrical power supply cord 42. FIG. 12 is an electrical schematic for the extractor 10.

The bottom housing 14 may comprise any suitable optional drain plug 44 for permitting waste cleaning liquid to be selectively drained from the housing 14, a mounting hole for the diffuser 18, and optional wheels 27 on which the extractor 10 may be rolled.

The bottom housing 14 may further comprise optional left and right viewing windows 46. Although two viewing windows 46 are illustrated there may be fewer or more viewing windows 46, or no viewing windows 46 at all. The purposes of the viewing windows 46 may include, for example, permitting the user to observe the action of the extractor 10 in separating the waste cleaning liquid from the aspirated air, and enabling the user to observe the depth of the pool 25 of waste cleaning liquid in the bottom of the vacuum chamber 72.

Turning now to FIGS. 6 and 8-9, the diffuser 18 may comprise an elongated hollow tube having a tubular internal cavity 17. The diffuser 18 may have a row of diffuser apertures 92 on each of its lateral sides (i.e., on each of its left and right sides); and its distal end 19 may either be left open, or it be provided with an optional plug 77. If its distal end 19 is left open, then the open distal end 19 may be considered to be a diffuser aperture 92

The plug 77 and it's the distal end 19 may be connected together in any suitable way, such as by the use of a friction fit; a threaded, glued or welded connection; or a mechanical coupler. Alternatively, the distal end 19 and the plug 77 may be formed together as one integral piece.

The diffuser 18 may be mounted in any suitable way within the vacuum chamber 72. For example, as seen in FIGS. 6 and 8-9, a hollow mounting fitting 81 may be provided for mounting the diffuser 18 within the vacuum chamber 72. The mounting fitting 81 may have a mounting flange 84 on its inlet end, and may be mounted with an airtight fit in a corresponding hole in the bottom housing 14 by using a pair of gaskets 85, 86 and a mounting nut 87 that may make a threaded connection with the exterior of the outlet end of the mounting fitting 81. Alternatively, the mounting fitting 81 may be mounted in the bottom housing 14 in any other suitable way, such as by the use of a friction fit; a glued or welded connection; or by a mechanical coupler. As a further alternative, the mounting fitting 81 and the bottom housing 14 may be formed together as one integral piece.

The inlet end of the diffuser 18 may be connected directly to the outlet end of the mounting fitting 81 in any suitable way, such as by the use of a friction fit; a threaded, glued or welded connection; or a mechanical coupler. Alternatively, the diffuser 18 and the mounting fitting 81 may be formed together as one integral piece.

However, if there is a size differential between the outer diameter of the diffuser 18 and the inner diameter of the hollow mounting fitting 81, or between the inner diameter of the diffuser 18 and the outer diameter of the mounting fitting 81, then any suitable adapter 78 may be used provide an airtight connection between the inlet end of the diffuser 18 and the outlet end of the mounting fitting 81, as best seen in FIG. 8. The diffuser 18, adapter 78 and mounting fitting 81 may be connected to each other in any suitably way, such as by the use of friction fits; threaded, glued or welded connections; or mechanical couplers. Alternatively, the diffuser 18, adapter 78 and mounting fitting 81 may be formed together as one integral piece.

The diffuser 18 and the outlet end of the vacuum hose 13 from the vacuum apparatus of the floor-cleaning machine with which the extractor 10 is being used may be connected together in any suitable way.

For example, as best seen in FIG. 8, an inlet fitting 88 may be provided between the outlet end of the vacuum hose 13 and the inlet end of the mounting fitting 81. Any suitable connection between the outlet end of the vacuum hose 13 and the inlet end of the inlet fitting 88 may be used, such the barbed connection seen in FIG. 8; a friction fit; a threaded, glued or welded connection; or a mechanical coupler.

Similarly, the outlet end of the inlet fitting 88 and the inlet end of the mounting fitting 81 may be connected together in any suitable way, such as by the use of a friction fit; a threaded, glued or welded connection; or a mechanical coupler. Alternatively, the inlet fitting 88 and the mounting fitting 81 may be formed together as one integral piece.

As a further alternative, the inlet fitting 88 may be eliminated, and the outlet end of the vacuum hose 13 and the inlet end of the mounting fitting 81 may be connected directly together in any suitable way, such as by the use of a friction fit; a barbed, threaded, glued or welded connection; or a mechanical coupler.

As a further alternative, the adapter 78, mounting fitting 81, mounting nut 87 and inlet fitting 88 may be eliminated, in which case the inlet end of the diffuser 18 may be elongated, mounted and sealed in any suitable way as it passes through the sidewall 96 of the bottom housing 14, and connected in any suitable way to the outlet end of the vacuum hose 13.

As another alternative, one or more of the adapter 78, mounting fitting 81 and inlet fitting 88 may be eliminated and the remaining parts 18, 78, 81 or 88 may be modified as needed in order to perform the functions of the eliminated part or parts 78, 81 or 88. For example, the adapter 78 may be eliminated, such as if the diffuser 18's inlet end and the mounting fitting 81's outlet end were sized and shaped so as to be able to be fitted or connected directly together.

In order to use the extractor 10 with any particular floor-cleaning machine, the outlet end of the floor-cleaning machine's vacuum hose 13 may be connected to the extractor 10's inlet fitting 88. Similarly, the inlet end of any suitable waste hose 21 may be connected to the outlet coupling 34 of the waste pump 37. Any suitable connection between the outlet coupling 34 and the inlet end of the waste hose 21 may be used, such as the use of a friction fit; a barbed, threaded, glued or welded connection; or a mechanical coupler.

The extractor 10's electrical cord 42 may then be plugged into any suitable source of electrical power, the switch 36 for the electric motor 43 for the waste pump 37 may be turned on, and one or both of the switches 38, 40 for the electric motors 60 of the vacuum pumps 39, 41 may be turned on. If the suction provided by one of the vacuum pumps 39, 41 is not sufficient for the proper or desired operation of the extractor 10, then both of the vacuum pumps 39, 41 may be turned on.

During operation of the extractor 10, its vacuum pumps 39, 41 may provide a source of vacuum for the floor cleaning machine's vacuum apparatus, to help enable the vacuum apparatus to remove the waste cleaning liquid from the floor that is being cleaned. As has been mentioned, along with the waste cleaning liquid, a large amount of air may be aspirated into the vacuum apparatus, and thus into the extractor 10, due to the imperfect seal that normally occurs between the vacuum apparatus and the floor that is being cleaned.

The aspirated air and waste cleaning liquid may then travel sequentially through the floor-cleaning machine's vacuum hose 13 and into extractor 10's inlet fitting 88, mounting fitting 81 and adapter 78, before entering and flowing through the extractor 10's diffuser 18.

The aspirated air delivered to the extractor 10 by the vacuum hose 13 may carry some of the waste cleaning liquid in the form of a mist of airborne particles of waste cleaning liquid of various sizes. In addition, the aspirated air may also carry foam that was generated by floor cleaning-machine with which the extractor 10 is being used, or that was generated by the turbulence within the vacuum hose 13. The remainder of the waste cleaning liquid may form an intermittent or continuous stream that is propelled along the bottom portions of the vacuum hose 13, inlet fitting 88, mounting fitting 81, adapter 78, and diffuser 18 by the stream of aspirated air that flows into the extractor 10 from the vacuum hose 13. The intermittent or continuous stream of waste cleaning liquid may then exit the diffuser 18 through its diffuser apertures 92 (and through its distal end 19 if there is no plug 77)

and drip, under the force of gravity, into the pool 25 of waste cleaning liquid that forms in the bottom of the vacuum chamber 72.

For simplicity of discussion, as used herein the term "airborne particles of waste cleaning liquid" is defined broadly to include airborne particles of waste cleaning liquid alone; foam alone (whether or not airborne), or a mixture of both foam (whether or not airborne) and airborne particles of waste cleaning liquid.

It is important that essentially none of the airborne particles of waste cleaning liquid that are carried by stream of aspirated air into the diffuser 18 be sucked into the inlets 62 of the extractor 10's vacuum pumps 39, 41 along with the aspirated air that is being expelled from the extractor 10, because they might damage the vacuum pumps 39, 41, or they might enter the room within which the extractor 10 is being used, where they might harm or soil the user or the room and its furnishings.

It has been discovered that the diffuser apertures 92 (and the open distal end 19 of the diffuser 18, if there is no plug 77), may have the favorable characteristic of helping to prevent the airborne particles of waste cleaning liquid within the diffuser 18 from being sucked into the inlets 62 of the vacuum pumps 39, 41.

It is theorized that this favorable characteristic occurs because the diffuser apertures 92 (and the diffuser 18's open distal end 19, if there is no plug 77), slow down the longitudinal velocity of the aspirated air and the airborne particles of waste cleaning liquid as they travel down the length of the diffuser 18 and out its open distal end 19, if there is no plug 77; and also slow down their lateral velocity (i.e., their velocity towards the left or right sides 96 of the bottom housing 14), as they exit the diffuser 18 though its diffuser apertures 92 in its lateral sides (i.e., its left and right sides). As a result, their dwell time within in the diffuser 18, and their dwell time within the vacuum chamber 72, are greater than would otherwise be the case.

This increase in their dwell time within the diffuser 18 may give more time for the airborne particles of waste cleaning liquid to coalesce and settle to the bottom of the diffuser 18, under the force of gravity, where they will then drip through its diffuser apertures 92 (and through its distal end 19 if there is no plug 77), into the pool 25 of waste cleaning liquid in bottom of the vacuum chamber 72. As used herein the term "coalesce" is defined to mean the merging together of particles of waste cleaning liquid, and to also mean the conversion of a foam back into the non-foamed liquid from which the foam was formed.

In addition, if there is any swirling or turbulence of the aspirated air within the diffuser 18, this increase in their dwell time within the diffuser 18 may give more time for the airborne particles of waste cleaning liquid to strike the inner surface of the diffuser 18, where they may coalesce, drain to the bottom of the diffuser 18, and then drip through its diffuser apertures 92 (and through its distal end 19 if there is no plug 77), into the pool 25 of waste cleaning liquid in the bottom of the vacuum chamber 72. This increase in their dwell time within the diffuser 18 may also give enough time for any swirling or turbulence within the diffuser 18 to subside to the point that the diffuser 18 generates essentially no significant amounts of new foam.

Similarly, this increase in their dwell time within the vacuum chamber 72 may give more time for any airborne particles of waste cleaning liquid within the vacuum chamber 72 to coalesce and fall, under the force of gravity, into the pool 25 of waste cleaning liquid in the vacuum chamber 72. In addition, if there is any swirling or turbulence of the aspirated air within the vacuum chamber 72, this increase in their dwell time within the vacuum chamber 72 may give more time for any airborne particles of waste cleaning liquid to strike the inner surface of the vacuum chamber 72 and the outer surface of the diffuser 18, where they may coalesce, and drain into the pool 25 of waste cleaning liquid in the bottom of the vacuum chamber 72. This increase in their dwell time within the vacuum chamber 72 may also give enough time for any swirling or turbulence within the vacuum chamber 72 to subside to the point that the vacuum chamber 72 generates essentially no significant amounts of new foam.

It has been discovered that the above desirable effect of helping to prevent airborne particles of waste cleaning liquid from being sucked into the inlets 62 of the vacuum pumps 39, 41 may be achieved if the ratio of the total area of the diffuser apertures 92 (which may include the cross-sectional area of the diffuser 18's cavity 17 at its distal end 19 if there is no plug 77), is selected to be relatively large as compared to the cross-sectional area of the diffuser 18's cavity 17, i.e., if the "diffuser apertures/cavity" area ratio is selected to be relatively large.

In this context, if the cross-sectional area of the diffuser 18's cavity 17 is not constant along the length of the cavity 17, then the area of the smallest cross-sectional area of the diffuser 18's cavity 17 may be used in determining the "diffuser apertures/cavity" area ratio.

It has also been discovered that, in general, as the flow rate of the aspirated air and airborne particles of waste cleaning liquid that enter the diffuser 18 is decreased, then the "diffuser apertures/cavity" area ratio that is needed to achieve the above desired effect may also decrease; and that as the flow rate of the aspirated air and particles of waste cleaning liquid that enter the diffuser 18 is increased, then the "diffuser apertures/cavity" area ratio that is needed to achieve the above desired effect may also increase.

It has been further discovered that when the "diffuser apertures/cavity" area ratio is selected to achieve the above desired effect of helping to prevent airborne particles of waste cleaning liquid from being sucked into the inlets 62 of the vacuum pumps 39, 41, then the velocity of the aspirated air that exits the diffuser 18 will also be low enough so that the exiting aspirated air will essentially not re-aerosolize or re-foam any of waste cleaning liquid that drips from the diffuser 18 through its diffuser apertures 92 (or through its distal end 19 if there is no plug 77) into the pool 25 of waste cleaning liquid in the bottom of the vacuum chamber 72.

Here again, it is preferred that such re-aerosolization and re-foaming be avoided since if any new foam or airborne particles of waste cleaning liquid were formed from dripping waste cleaning liquid, they might be sucked into the inlets 62 of the vacuum pumps 39, 41 along with the exiting aspirated air, where they might cause damage, or they might enter the room within which the extractor 10 is being used, where they might harm or soil the user or the room and its furnishings.

In general, the flow rate of the aspirated air and airborne particles of waste cleaning liquid through the vacuum hose 13 and the diffuser 18 will depend on such variables as: (a) the size and construction of the vacuum apparatus of the particular floor cleaning machine with which the extractor 10 is being used; (b) the tightness of the seal between the vacuum apparatus and the floor being cleaned, (c) the length and inner diameter of the vacuum hose 13, (d) the respective length and inner cross-sectional area of the inlet fitting 88, mounting fitting 81 and diffuser 18's cavity 17, (e) the total area of the diffuser apertures 92 (including the cross-sectional area of the cavity 17 at the diffuser 18's distal end 19 if there is no plug 77), (f) the power and number of the vacuum pumps 39, 41, and (g) the size of the air inlets 61 and air outlets 64 of the vacuum pumps 39, 41 through which the aspirated air travels before being expelled from the extractor 10.

By way of example, some specifications relating to the extractor 10 and some of its components will now be given.

The vacuum chamber 72 may have an overall length of about 18 inches, an overall width of about 12 inches and an overall height of about 10 inches. When the diffuser 18 is installed in the vacuum chamber 72, its top may be about 2.5 inches from the deck plate 48 and its bottom may be about 5 inches from the bottom 95 of the vacuum chamber 72. The diffuser 18 may be about 14 inches long, its cavity 17 may have a diameter of about 2 inches; and each of its twelve diffuser apertures 92 may be about 1.25 inches in diameter. Such a diffuser 18 would have a "diffuser apertures/cavity" area ratio that is equal to about 5:1, assuming that a plug 77 were provided for the diffuser 18's distal end 19.

It has been discovered that an extractor 10 having the above dimensions and the construction illustrated in the Figures will be able to extract essentially all of the waste cleaning liquid from a flow rate of aspirated air through the extractor 10 of about 192 cubic feet per minute, if the "diffuser apertures/cavity" area ratio has a minimum that falls in the range of at least about 3.5:1 to 5:1. Of course, such an extractor 10 that has such a minimum area ratio will always be able to extract essentially all of the waste cleaning liquid from a flow rate of aspirated air through the extractor 10 that is less than about 192 cubic feet per minute, i.e., from a flow rate that is greater than zero and up to about 192 cubic feet per minute.

It has been discovered that at the above flow rate of about 192 cubic feet per minute, increasing this minimum area ratio may not improve the performance of the extractor 10, since essentially all of the waste cleaning liquid was already being extracted from the flow of aspirated air through the extractor 10 at this minimum area ratio.

It has also been discovered that, in general, the minimum "diffuser apertures/cavity" area ratio that is needed for the extractor 10 to extract essentially all of the waste cleaning liquid from the flow of aspirated air through the extractor 10 will decrease as the flow rate of the aspirated air decreases, and increase as the flow of aspirated air through the extractor 10 increases.

It is understood that any or all of the parts of the extractor 10 may be scaled up or down in their respective dimensions, and in their other physical properties, to result in an extractor 10 that can remove essentially all of the waste cleaning liquid from any desired flow rate of aspirated air through the extractor 10.

It has also been discovered that the above desirable effect of helping to prevent airborne particles of waste cleaning liquid from being sucked into the inlets 62 of the vacuum pumps 39, 41 may be achieved by locating the diffuser apertures 92 so that they "face away" from the inlets 62 of the vacuum pumps 39, 41. In this context to "face away" means that the aspirated air that exits from the diffuser apertures 92 will not follow a direct path from the diffuser apertures 92 to the inlets 62 of the vacuum pumps 39, 41. For example, as seem in FIGS. 8-9 the diffuser apertures 92 (which are located in the lateral sides of the diffuser 18), "face away" from the air inlets 62 because aspirated air that exits from the diffuser apertures 92 will follow the indirect paths 15 from the diffuser apertures 92 to the inlets 62 of the vacuum pumps 39, 41. Similarly, the diffuser apertures 92*b* of the diffuser 18*b* seen in FIG. 14 "face away" from the inlets 62 of the vacuum pumps 39, 41 because the diffuser apertures 92*b* face towards the pool 25 of separated waste cleaning liquid in the bottom of the vacuum chamber 72. As a result, the aspirated air that exits from the diffuser apertures 92*b* will not follow a direct path from the diffuser apertures 92*b* to the inlets 62 of the vacuum pumps 39, 41 since the inlets 62 are located above the diffuser 18*b*.

It is theorized that the desirable effect of helping to prevent airborne particles of waste cleaning liquid from being sucked into the inlets 62 of the vacuum pumps 39, 41 may occur because with such a construction the streams of aspirated air exiting through the diffuser apertures 92, and any airborne particles of waste cleaning liquid that they may carry, will exit from the diffuser apertures 92 at least generally horizontally, and then follow the indirect paths from the diffuser apertures 92 towards the inlets 62 of the vacuum pumps 39, 41 that are indicated by the air flow arrows 15 in FIGS. 8-9.

In general, as best seen in FIG. 9, the horizontal streams will travel laterally across the vacuum chamber 72 until they are deflected by one of the sidewalls 96 of the vacuum chamber 72. Part of the streams will be deflected upwardly by the sidewalls 96 and travel until they enter the inlets 62 of the vacuum pumps 39, 41. Another part of them will be deflected downwardly by the sidewalls 96 and follow longer indirect paths within the vacuum chamber 72 before they enter the inlets 62 of the vacuum pumps 39, 41. In either case, none of them travel directly from the diffuser apertures 92 to the inlets 62 of the vacuum pumps 39, 41, thereby reducing any possibility that the aspirated air will carry any airborne particles of waste cleaning liquid directly into the inlets 61.

It is further theorized that there may be three mechanisms by which any particles of waste cleaning liquid may be extracted from the streams of aspirated air that exit from the diffuser apertures 92. First, as the horizontal streams impact on the sidewalls 96 of the vacuum chamber 72, the inertia of any airborne particles of waste cleaning liquid that they may carry will tend to cause the particles to impact onto the sidewalls 96, where they then may coalesce, and flow down the sidewalls 96 into the pool 25 of waste cleaning liquid under the force of gravity and under the urging of the downwardly deflected streams of aspirated air.

Second, because of the long, indirect paths followed by the streams of aspirated air within the vacuum chamber 72, enough dwell time may be provided within the vacuum chamber 72 for at least some of any airborne particles of waste cleaning liquid to coalesce and fall into the pool 25 of waste cleaning liquid under the force of gravity.

In addition, if there is any swirling or turbulence of the aspirated air within the vacuum chamber 72, because of the long, indirect paths followed by the streams of aspirated air within the vacuum chamber 72, enough dwell time may be provided within the vacuum chamber 72 for at least some of any airborne particles of waste cleaning liquid to strike the inner surface of the vacuum chamber 72 and the outer surface of the diffuser 18, where they will then coalesce and drain into the pool 25 of waste cleaning liquid in the bottom of the vacuum chamber 72.

It has also been discovered that as the aspirated air and airborne particles of waste cleaning liquid travel longitudinally through the diffuser 18, the vertical component of their velocities may be reduced, such as by viscous friction forces between the aspirated air and the inside surface of the diffuser 18. It has been further discovered that this effect may be advantageously utilized if the diffuser 18 is oriented at least generally horizontally. If this is done, then because of the reduced vertical velocity component of the aspirated air and airborne particles of waste cleaning liquid, an increased number of airborne particles of waste cleaning liquid within the diffuser 18 will be able to fall, under the force of gravity, to the bottom of the diffuser 18, coalesce, and then drip into the pool 25 of waste cleaning liquid in the bottom of the vacuum chamber 72.

It may be preferred that the diffuser 18 has a tilt angle of no more than about 45 degrees from a horizontal plane.

Although the diffuser 18 and its cavity 17 are illustrated as having a tubular configuration, as having circular cross-sectional shapes, and as having a constant cross-sectional area and shape along their lengths, they may have any other configuration, they may have any other geometric or non-geometric cross-sectional configuration, and their cross-sectional areas and shapes along their lengths may not be constant. Although the diffuser 18 is illustrated as being straight along its length and as having a longitudinal axis that lies in a single flat plane, it may not be straight along its length, such as if it were zigzagged, curved, or sinuous; and its longitudinal axis may not lie in a single flat plane.

Although only a single diffuser 18 is illustrated, there may be an array of more than one diffuser 18. Any particular diffuser 18 in the array may be connected directly to the adapter 78, or it may be indirectly connected to the adapter 78, such as through any suitable header. The diffusers 18 in the array may, or may not, lie in the same plane.

Although twelve diffuser apertures 92 are illustrated in the Figures, there may be as few as one diffuser aperture 92, or more than 12 diffuser apertures. Although the diffuser apertures 92 are illustrated as being relatively large in size, they may have any desired size, and may be as small as 1 mm, or less. In general, the smaller the size of the diffuser apertures 92, the more of them there will be, in order to permit any predetermined desired rate of flow of aspirated air through the extractor 10.

Although the diffuser apertures 92 are illustrated as being round, they may have any other geometric or non-geometric shape, and they may take the form of slots rather than being round. Although the diffuser apertures 92 are illustrated as being uniform in size and shape, and as being spaced an equal distance from each other in two opposed rows along the length of the diffuser 18, the rows may not be opposed and the diffuser apertures 92 may not be uniform in size and shape, they may not be arranged in rows, and they may not be spaced an equal distance from each other along the length of the diffuser 18.

Although the diffuser apertures 92 are illustrated as being located on the lateral sides (i.e., the left and right sides), of the diffuser 18, they may be located on only one lateral side of the diffuser 18. In addition, the diffuser apertures 92 may be located on any side of the diffuser 18 including its top, bottom and lateral sides.

It may be preferred that no diffuser apertures 92 be located on the top side of the diffuser 18, in order to help prevent the aspirated air that exits from the diffuser apertures 92 from tending to carry airborne particles of waste cleaning liquid directly into the inlets 62 of vacuum pumps 39, 41.

However, as an alternative, it is possible for the top side of the diffuser 18 to have diffuser apertures 92; in which case a baffle of any suitable size and shape may be mounted to the bottom of the deck plate 48, to the top side of the diffuser 18, or to any other suitable part of the extractor 10, to help prevent the aspirated air from carrying airborne particles of waste cleaning liquid directly into the inlets 62 of vacuum pumps 39, 41.

Figure 13:
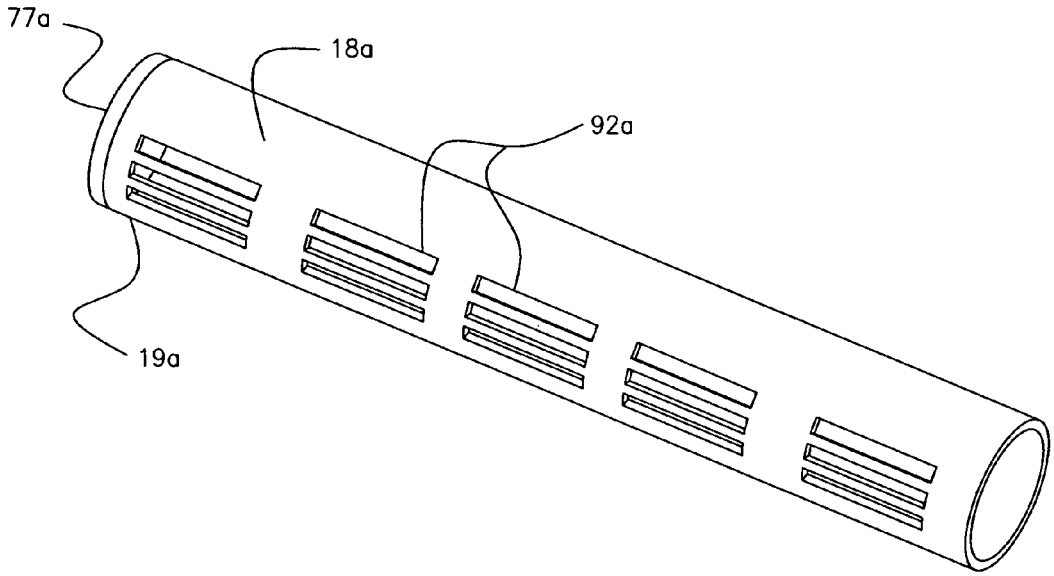
FIG. 13 is a perspective view of an alternative diffuser 18*a*, taken from an upper left aspect.

Turning now to FIG. 13, it illustrates a second embodiment 18*a* of the diffuser 18 of FIGS. 6-8 and 9. It is understood that the diffusers 18, 18*a* and 18*b* are the same as each other, or are at least similar to each other, in any particular respect such as with respect to their respective mountings, locations, physical features, physical properties, quantities (how many), sizes, shapes, designs, materials, compositions, constructions, manufactures, dimensions, specifications, variations, operations, methods and uses, except for those differences which will be made apparent by all of the disclosures herein. Accordingly, for clarity and simplicity, certain parts of the diffuser 18*a* of FIG. 13 have been given the same reference numerals as the diffuser 18 of FIGS. 6-8 and 9, but with an "a" suffix; e.g., parts 19*a* and 77*a* of the diffuser 18*a* of FIG. 13 correspond, respectively, to parts 19 and 77 of the diffuser 18 of FIGS. 6-8, and 9.

In the diffuser 18*a* seen in FIG. 13, the diffuser 18's single row of round diffuser apertures 92 on each of the diffuser 18's lateral sides has been replaced by three rows of elongated diffuser slots 92*a* on each of the lateral sides of the diffuser 18*a*. The waste cleaning liquid may drip into the pool 25 of waste cleaning liquid in the bottom of the vacuum chamber 72 though the lowest row of diffuser slots 92*a* on each of the lateral sides of the diffuser 18*a*.

Figure 14:
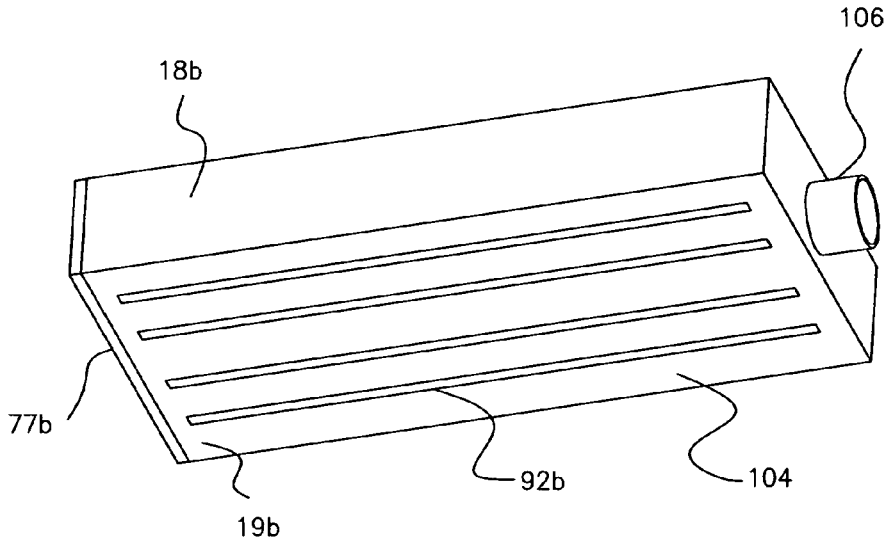
FIG. 14 is a perspective view of an alternative diffuser 18*b*, taken from a lower left aspect.

Turning now to FIG. 14, it illustrates a third embodiment 18*b* of the diffuser 18 of FIGS. 6-8 and 9. It is understood that the diffusers 18, 18*a*, 18*b* are the same as each other, or are at least similar to each other, in any particular respect such as with respect to their respective mountings, locations, physical features, physical properties, quantities (how many), sizes, shapes, designs, materials, compositions, constructions, manufactures, dimensions, specifications, variations, operations, methods and uses, except for those differences which will be made apparent by all of the disclosures herein. Accordingly, for clarity and simplicity, certain parts of the diffuser 18*b* of FIG. 14 have been given the same reference numerals as the diffuser 18 of FIGS. 6-8 and 9, but with a "b" suffix; e.g., parts 19*b* and 77*b* of the diffuser 18*b* of FIG. 14 correspond, respectively, to parts 19 and 77 of the diffuser 18 of FIGS. 6-8, and 9.

As seen in FIG. 14, the diffuser 18*b* may be generally rectangular in configuration, and may have a number of diffuser slots 92*b* in its bottom side 104.

The diffuser 18*b* may be mounted to the lower housing 14 and connected to the vacuum hose 13 in any suitable way such as by using its mounting neck 106. The bottom side 104 may be flat, or may have any non-flat configuration.

It has been discovered that the diffuser 18*b* may be particularly effective at separating airborne particles of waste cleaning liquid from the aspirated air that flows through it.

It is theorized that this may be the result of locating the diffuser slots 92*b* on its bottom surface 104, and by arranging the diffuser 18*b* so that its bottom surface 104 faces the pool 25 of waste cleaning liquid in the bottom of the vacuum chamber 72. As a result of this construction and arrangement, when the streams of aspirated air and airborne particles of waste cleaning liquid leave the diffuser 18 through its diffuser slots 92*b*, all of the airborne particles of waste cleaning liquid will be carried directly towards the pool 25, and tend to impact upon and form a part of, the pool 25, rather than being sucked into the inlets 62 of the vacuum pumps 39, 41.

In addition, this construction and arrangement will enhance the dwell time within the vacuum chamber 72 of any remaining airborne particles of waste cleaning liquid, due to the fact that any remaining airborne particles will have to first travel down towards the pool 25, and then sideways, up, and around the diffuser 18*b* before they could possibly be sucked into the inlets 62 of the vacuum pumps 39, 41. This enhanced dwell time will increase the opportunity for any remaining airborne particles to coalesce on the inner surface of the vacuum chamber 72 or on the outer surfaces of the diffuser 18*b*, and then flow or drip into the pool 25.

It has also been discovered that because the aspirated air exits from the diffuser slots 92*b* directly down toward the pool 25, the aspirated air will have essentially no tendency to re-aerosolize or re-foam any of waste cleaning liquid that drips from the diffuser 18*b* through its diffuser slots 92*b* (or through its distal end 19 if there is no plug 77) into the pool 25.

From the forgoing, it will be appreciated that specific embodiments of the invention have been described herein for purposes of illustration, and that various modification may be made without deviating from the invention. Additionally, aspects of the invention described in the context of particular embodiments may be combined or eliminated in other embodiments. Although advantages associated with certain embodiments of the invention have been described in the context of those embodiments, other embodiments may also exhibit such advantages. Further, not all embodiments need necessarily exhibit such advantages to fall within the scope of the claimed invention.

It is to be understood that any particular part of the extractor 10 may be suitably combined or formed with one or more of its other parts to form a composite part, without departing from the scope and spirit of the present invention; that any particular part of the extractor 10 described as being made in one piece may be formed by assembling together in any suitable way, two or more sub-pieces; and that the various parts of the invention may be assembled together in any suitable ways other than those described herein by using any appropriate means, such as fasteners, welding, adhesives, bonding, threads, friction fits, interference fits, splines, keys, etc., without departing from the scope and spirit of the present invention.

When the phrase "at least one of" is used in any of the claims, that phrase is defined to mean that any one, any more than one, or all, of the listed things or steps following that phrase is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, or all of A, B and C.

Before an element in a claim is construed as claiming a means for performing a specified function under 35 USC section 112, last paragraph, the words "means for" must be used in conjunction with that element.

It is understood that the foregoing forms of the invention were described and illustrated strictly by way of non-limiting example.

As used herein, the term "fluid" is defined to include both liquids and gasses.

As used herein, except in the claims, the words "and" and "or" are each defined to also carry the meaning of "and/or".

In view of all of the disclosures herein, these and further modifications, adaptations and variations of the present invention will now be apparent to those of ordinary skill in the art to which it pertains, within the scope of the following claims.

What is claimed is:

1. An improved extractor that is operable to remove waste cleaning liquid from a mixture of aspirated air and waste cleaning liquid that is delivered to said extractor by a vacuum hose; wherein said extractor comprises:

a vacuum chamber;

a vacuum pump that is operable to apply a vacuum to said vacuum chamber; and a diffuser mounted within said vacuum chamber;

wherein said diffuser is in fluid communication with said vacuum hose;

wherein said diffuser comprises an internal diffuser cavity and a diffuser aperture that is in fluid communication with said internal diffuser cavity; and wherein, during operation of said extractor, said mixture is sucked into said diffuser cavity by said vacuum pump; wherein said diffuser is operable to separate at least some of said waste cleaning liquid from said mixture; wherein said separated waste cleaning liquid and said aspirated air flow out of said diffuser cavity through said diffuser aperture and into said vacuum chamber; wherein all of said diffuser is not submerged in said waste cleaning liquid in said vacuum chamber; and wherein said vacuum pump is operable to suck said aspirated air out of said vacuum chamber.

2. The extractor of claim 1, wherein said diffuser is operable to separate essentially all of said waste cleaning liquid from said mixture.

3. The extractor of claim 1, wherein said diffuser has a total diffuser aperture area and a diffuser cavity cross-sectional area; wherein said extractor has a "diffuser apertures/cavity" area ratio that is equal to said total diffuser aperture area divided by said diffuser cavity cross-sectional area; wherein said ratio is selected to have a minimum value that falls in a range of at least about 3.5:1 to 5:1; and wherein said selected ratio results in a dwell time of said mixture inside of said diffuser cavity that is sufficient to make said diffuser operable to separate at least some of said waste cleaning liquid from said mixture.

4. The extractor of claim 3, wherein said diffuser has an inner surface and an outer surface; wherein said vacuum chamber has an inner surface; wherein at least a portion of said mixture comprises airborne particles of said waste cleaning liquid; wherein said selected ratio results in a dwell time of said airborne particles inside of said diffuser cavity that is sufficient to make said inner surface of said diffuser operable to separate at least some of airborne particles from said mixture by a coalescence of at least some of said airborne particles on said inner surface of said diffuser; and wherein said selected ratio results in a dwell time of said airborne particles inside of said vacuum chamber that is sufficient to make at least a portion of said outer surface of said diffuser and at least a portion of said inner surface of said vacuum chamber operable to separate at least some of airborne particles from said mixture by a coalescence of at least some of said airborne particles on at least a portion of said outer surface of said diffuser and on at least a portion of said inner surface of said vacuum chamber.

5. The extractor of claim 1, wherein said vacuum pump comprises a vacuum pump inlet; wherein said separated waste cleaning liquid forms a pool in a bottom portion of said vacuum chamber beneath said diffuser; and wherein said vacuum pump inlet is located above said pool, to prevent at least some of said separated waste cleaning liquid from entering said vacuum pump inlet.

6. The extractor of claim 5, wherein said extractor further comprises a suction hose and a pump that are in fluid communication with each other; and wherein said suction hose and said pump are operable to remove at least some of said separated waste cleaning liquid in said pool from said extractor.

7. The extractor of claim 1, wherein said vacuum pump comprises a vacuum pump inlet; wherein there are at least two of said diffuser aperture; and wherein all of said diffuser apertures face away from said vacuum pump inlet, to help make said diffuser operable to separate at least some of said waste cleaning liquid from said mixture.

8. The extractor of claim 1, wherein said vacuum pump comprises a vacuum pump inlet; wherein said diffuser has an outer surface; wherein said vacuum chamber has an inner surface; wherein at least a portion of said mixture comprises airborne particles of said waste cleaning liquid; wherein there are at least two of said diffuser aperture; wherein all of said diffuser apertures face away from said vacuum pump inlet, to cause at least some of said airborne particles to follow indirect paths within said vacuum chamber from said diffuser apertures towards said vacuum pump inlet; and wherein said indirect paths enable at least a portion of said outer surface of said diffuser and at least a portion of said inner surface of said vacuum chamber to be operable to separate at least some of said airborne particles from said mixture by a coalescence of at least some of said airborne particles on at least a portion of said outer surface of said diffuser and on at least a portion of said inner surface of said vacuum chamber.

9. The extractor of claim 8, wherein said diffuser has a lateral side; and wherein said diffuser aperture is located on said lateral side of said diffuser.

10. The extractor of claim 8, wherein said diffuser has a bottom side; wherein said diffuser aperture is located in said bottom side; wherein said separated waste cleaning liquid forms a pool in a bottom portion of said vacuum chamber beneath said diffuser; wherein said separated waste cleaning liquid and said aspirated air that flow through said diffuser aperture are directed by said diffuser aperture to flow towards said pool of separated waste cleaning liquid, to prevent at least some of said separated waste cleaning liquid from entering said vacuum pump inlet.

11. The extractor of claim 10, wherein at least a portion of said mixture of aspirated air and said waste cleaning liquid comprises airborne particles of said waste cleaning liquid; wherein at least some of said airborne particles are directed by said diffuser aperture to flow towards, and into, said pool of separated waste cleaning liquid, to separate at least some of airborne particles from said mixture.

12. The extractor of claim 1, wherein at least a portion of said mixture of aspirated air and said waste cleaning liquid comprises airborne particles of said waste cleaning liquid; wherein said diffuser has an at least generally horizontal orientation within said vacuum chamber, and wherein said at least generally horizontal orientation of said diffuser helps to make said diffuser operable to separate at least some of said airborne particles from said aspirated air that is located within said diffuser, by a descent under the force of gravity of at least some of said airborne particles to a bottom surface of said diffuser, and by a coalescence of at least some of said airborne particles on said bottom surface of said diffuser.

13. The extractor of claim 12, wherein said diffuser has a tilt angle of no more than about 45 degrees from a horizontal plane.

14. The extractor of claim 1, wherein said diffuser has an elongated, tubular configuration.

15. The extractor of claim 1, wherein said diffuser has a rectangular configuration.

16. The extractor of claim 1, wherein said diffuser has a longitudinal axis, and wherein said longitudinal axis lies in one flat plane.

17. The extractor of claim 1, wherein said diffuser is at least one of straight, zigzagged, curved, and sinuous along its length.

18. The extractor of claim 1, wherein said extractor further comprises an array of at least two of said diffusers.

* * * * *